US010634420B2

(12) United States Patent
Wantland et al.

(10) Patent No.: US 10,634,420 B2
(45) Date of Patent: Apr. 28, 2020

(54) LINER SUPPORTED SHELF ASSEMBLY FOR A REFRIGERATOR APPLIANCE

(71) Applicant: Haier US Appliance Solutions, Inc., Wilmington, DE (US)

(72) Inventors: Louis A. Wantland, Louisville, KY (US); Bagawathkumar Chellappan, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 4 days.

(21) Appl. No.: 15/989,264

(22) Filed: May 25, 2018

(65) Prior Publication Data

US 2019/0360742 A1 Nov. 28, 2019

(51) Int. Cl.

| | |
|---|---|
| ***A47B 96/04*** | (2006.01) |
| ***F25D 23/06*** | (2006.01) |
| ***F25D 27/00*** | (2006.01) |
| ***F25D 25/02*** | (2006.01) |

(52) U.S. Cl.

CPC ..... *F25D 23/067* (2013.01); *F25D 23/066* (2013.01); *F25D 25/02* (2013.01); *F25D 27/00* (2013.01)

(58) Field of Classification Search

CPC ..... F25D 23/066; F25D 23/067; F25D 2325/022; F25D 2325/023

See application file for complete search history.

(56) References Cited

U.S. PATENT DOCUMENTS

| | | | | |
|---|---|---|---|---|
| 2,997,356 | A * | 8/1961 | Hilliker | F25D 25/024 312/408 |
| 3,506,325 | A * | 4/1970 | Horvay | F25D 25/02 312/223.5 |
| 3,637,085 | A * | 1/1972 | Ball | A47B 96/021 211/153 |
| 4,904,032 | A | 2/1990 | Jenkins | |
| 4,936,641 | A * | 6/1990 | Bussan | F25D 25/02 211/134 |
| 5,642,924 | A | 7/1997 | Wohlrab et al. | |
| 5,893,620 | A * | 4/1999 | Birgelis | F25D 23/067 312/334.44 |
| 8,721,014 | B2 | 5/2014 | Yang | |
| 2002/0023915 | A1* | 2/2002 | Taplan | A47J 36/04 219/452.11 |
| 2007/0210089 | A1* | 9/2007 | Kauk | B29C 44/16 220/592.1 |
| 2010/0181884 | A1* | 7/2010 | De La Garza | F25D 25/024 312/408 |
| 2012/0043338 | A1 | 2/2012 | Yang | |
| 2018/0100687 | A1* | 4/2018 | Ammerman | F25D 25/02 |

FOREIGN PATENT DOCUMENTS

WO WO2016187743 A1 12/2016

* cited by examiner

*Primary Examiner* — Matthew W Ing
(74) *Attorney, Agent, or Firm* — Dority & Manning, P.A.

(57) ABSTRACT

A refrigerator appliance having a liner supported shelf is provided. The liner includes mounting features that provide for secure mounting of a shelf thereto. The shelf includes mounting features that securely engage the mounting features of the liner at multiple contact loading points.

20 Claims, 10 Drawing Sheets

LINER SUPPORTED SHELF ASSEMBLY FOR A REFRIGERATOR APPLIANCE

FIELD OF THE INVENTION

The present subject matter relates generally to consumer appliances, and more particularly to shelf assemblies for refrigerator appliances.

BACKGROUND OF THE INVENTION

Consumer appliances, such as refrigerator appliances, generally include a cabinet that defines an internal chamber. In the case of refrigerator appliances, a chilled chamber may be defined for receipt of food articles for storage. Refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

Some existing refrigerator appliances include one or more shelves for holding or supporting food items within the chilled chamber. The shelves of such refrigerator appliances may be mounted in a number of different ways. For instance, the liner positioned within the cabinet of some refrigerator appliances include protrusions that extend out from the liner. Other refrigerator appliances have metal brackets attached to the liner that provide a number of shelf mounting positions. Some refrigerator appliances include a combination of liner protrusions and metal brackets.

These approaches present certain challenges. For instance, protrusions extending from the liner take away from the storage capacity of the shelf and/or the space of the chilled chamber. Further, the shelves mounted to such protrusions may require additional structural support if the span between the liner protrusions is too large. Metal brackets may be costly and may make it more difficult to store tall food items as the tall food items may contact the brackets. Moreover, metal brackets take away from the storage capacity of the chilled chamber.

Accordingly, an appliance with features that address one or more of the challenges noted above would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a refrigerator appliance is provided. The refrigerator appliance includes a cabinet and a liner positioned within the cabinet and defining a chilled chamber. The liner comprises a shelf mounting structure integrally formed with the liner. The shelf mounting structure includes a bottom wall and a bottom projection projecting from the bottom wall. The shelf mounting structure also includes a top wall spaced from the bottom wall and a top projection projecting from the top wall. The top wall, the top projection, the bottom wall, and the bottom projection define a mounting recess. An opening of the mounting recess is defined between the bottom projection and the top projection. The refrigerator appliance also includes a shelf removably mounted to the liner. The shelf includes a panel and a frame connected to the panel and having a receiving member that is removably insertable into the mounting recess. The receiving member of the frame comprising a top contacting projection. When the shelf is mounted to the shelf mounting structure, the top contacting projection of the frame of the shelf engages the top wall of the shelf mounting structure and the panel of the shelf engages the bottom projection of the shelf mounting structure.

In another aspect of the present disclosure, a refrigerator appliance is provided. The refrigerator appliance includes a cabinet and a liner positioned within the cabinet and defining a chilled chamber and a groove. The refrigerator appliance also includes a shelf mounting structure disposed within the groove and connected to the liner. The shelf mounting structure includes a bottom wall and a bottom projection projecting from the bottom wall. The shelf mounting structure also includes a top wall spaced from the bottom wall and a top projection projecting from the top wall. The top wall, the top projection, the bottom wall, and the bottom projection define a mounting recess. The refrigerator appliance also includes a shelf removably mounted to the liner. The shelf includes a panel and a frame connected to the panel and having a receiving member that is removably insertable into the mounting recess. The receiving member of the frame comprises a top contacting projection. The top contacting projection comprising a contacting end having a curved surface. Further, when the shelf is mounted to the shelf mounting structure, the curved surface of the contacting end of the top contacting projection engages the top wall of the shelf mounting structure and the panel of the shelf engages the bottom projection of the shelf mounting structure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
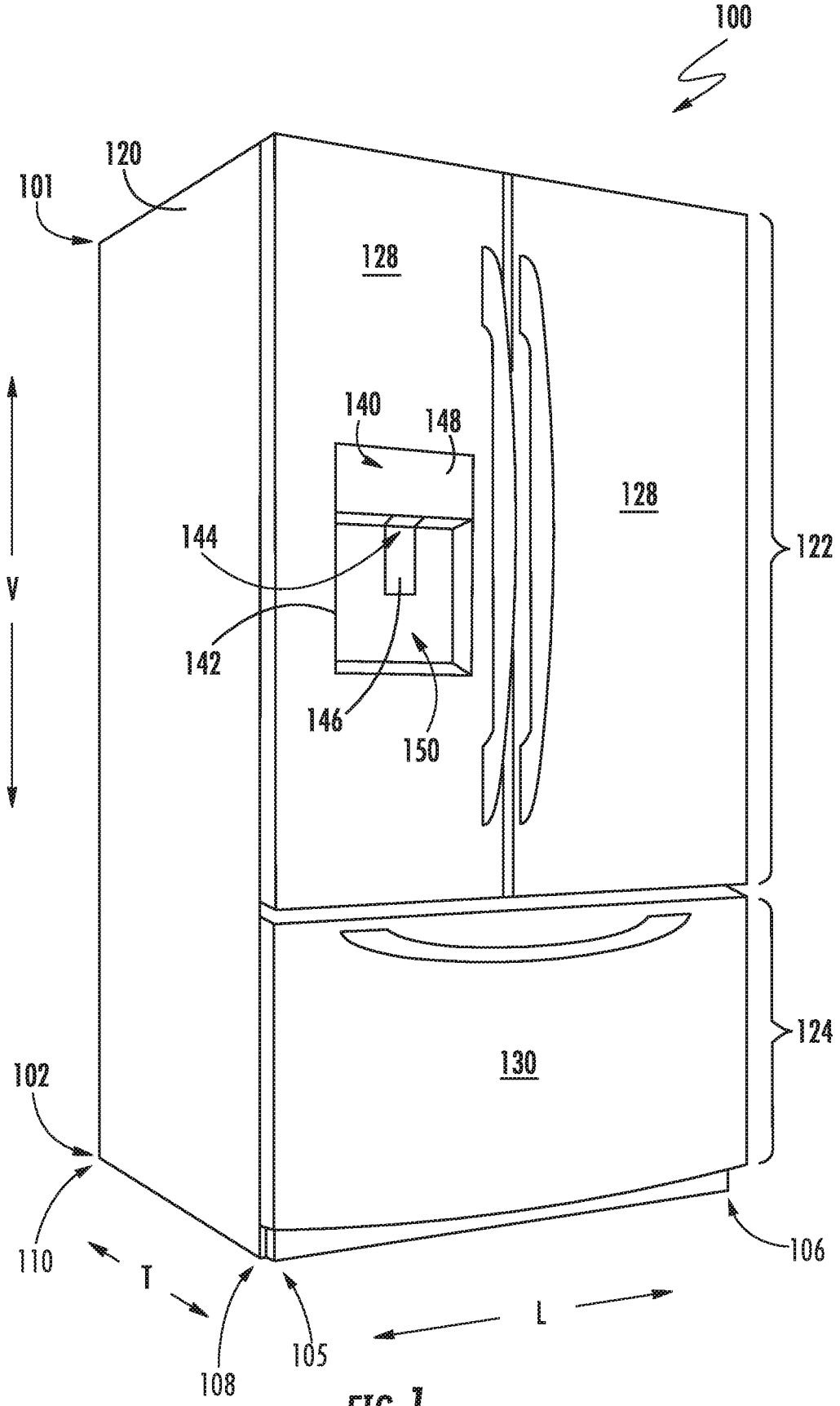
FIG. 1 provides a perspective view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. Furthermore, as used herein, terms of approximation, such as "approximately," "substantially," or "about," refer to being within a ten percent margin of error.

Figure 2:
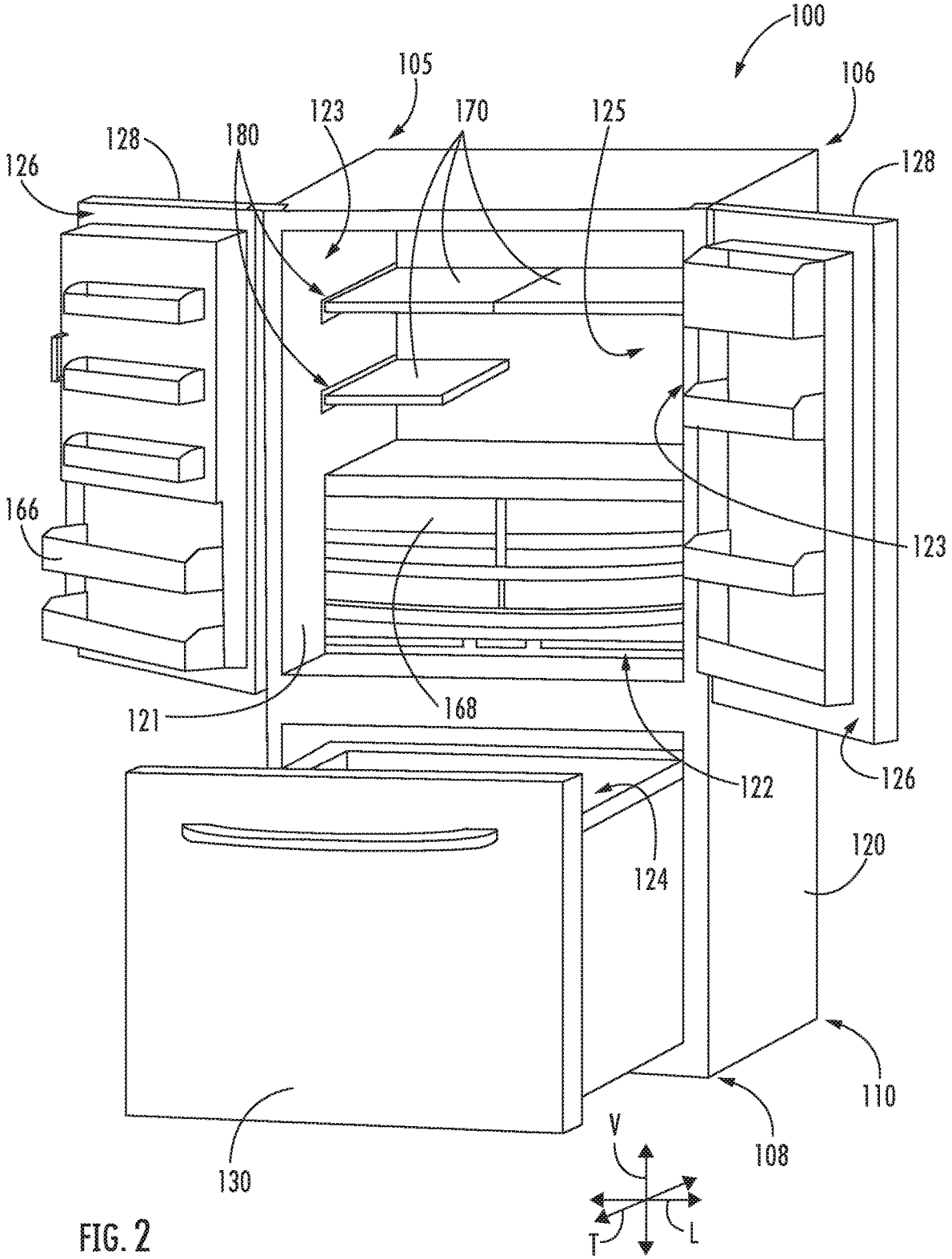
FIG. 2 provides a perspective view of the example refrigerator appliance of FIG. 1, wherein refrigerator doors of the refrigerator appliance are in an open position to reveal a fresh food chamber of the refrigerator appliance.

FIGS. 1 and 2 provide various views of a refrigerator appliance 100 according to an example embodiment of the present disclosure. In particular, FIG. 1 provides a perspective view of refrigerator appliance 100 and FIG. 2 provides another perspective view of refrigerator appliance 100 having multiple refrigerator doors 128 in the open position. As shown, refrigerator appliance 100 includes an outer casing or cabinet 120 that extends between a top 101 and a bottom 102 along a vertical direction V. Cabinet 120 extends between a first side 105 and a second side 106 along a lateral direction L and between a front 108 and a rear 110 along a transverse direction T. The vertical direction V, lateral direction L, and transverse direction T are mutually perpendicular to one another and define an orthogonal direction system.

A liner 121 (FIG. 2) is positioned within the cabinet 120. Liner 121 defines chilled chambers for receipt of food items for storage. In particular, liner 121 defines a fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure apply to other types and styles of appliances such as, e.g., a top mount refrigerator appliance, a side-by-side style refrigerator appliance, or a range appliance. Consequently, the description set forth herein is for illustrative purposes only and is not intended to be limiting in any aspect to any particular refrigerator chamber configuration. Further, as shown in FIG. 2, liner 121 includes opposing liner sidewalls 123 and a liner rear wall 125 positioned at rear 110 of cabinet 120.

Refrigerator doors 128 are rotatably hinged to an edge of cabinet 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1 and in the open configuration in FIG. 2. Refrigerator doors 128 may each include liners 126 as well. Freezer door 130 may likewise include a liner.

In some embodiments, as shown in FIG. 1, refrigerator appliance 100 includes a dispensing assembly 140 for dispensing liquid water and/or ice. Dispensing assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128.

According to the illustrated embodiment, as shown in FIG. 2, various storage components are mounted within fresh food chamber 122 to facilitate storage of food items therein as will be understood by those skilled in the art. In particular, the storage components include storage bins 166, drawers 168, and shelves 170 that are mounted within fresh food chamber 122. Storage bins 166, drawers 168, and shelves 170 are configured for receipt of food items (e.g., beverages and/or solid food items) and may assist with organizing such food items. As an example, drawers 168 can receive fresh food items (e.g., vegetables, fruits, and/or cheeses) and increase the useful life of such fresh food items.

Further, in accordance with exemplary aspects of the present disclosure, liner 121 includes one or more integrally formed shelf mounting structures 180 that provide shelf mounting positions for shelves 170 to be mounted directly to liner 121. For instance, shelf mounting structures 180 may be integrally formed with liner 121 by molding or additively printing the shelf mounting structures 180 with liner 121 during manufacturing. Thus, in such embodiments, the shelf mounting structures 180 are formed as a single, monolithic piece with liner 121. As depicted in FIG. 2, for this embodiment, liner 121 includes integrally formed shelf mounting structures 180 along liner sidewalls 123. The shelves 170 positioned at first side 105 of cabinet 120 are cantilevered from their respective shelf mounting structures 180 defined in the liner sidewall 123 positioned proximate the first side 105 of cabinet 120. The shelf 170 positioned at second side 106 of cabinet 120 is likewise cantilevered from its shelf mounting structure 180 defined in the liner sidewall 123 positioned proximate second side 106 of cabinet 120. In some exemplary embodiments, additionally or alternatively, liner rear wall 125 and/or door liners 126 may likewise define shelf mounting structures 180. Shelf mounting structures 180 may extend along the entire length of one of the liners, substantially along the length of one or the wall of the liner, or a portion of the length of one of the liners. Exemplary shelf mounting structures and shelf assemblies will be described in further detail below.

Figure 3:
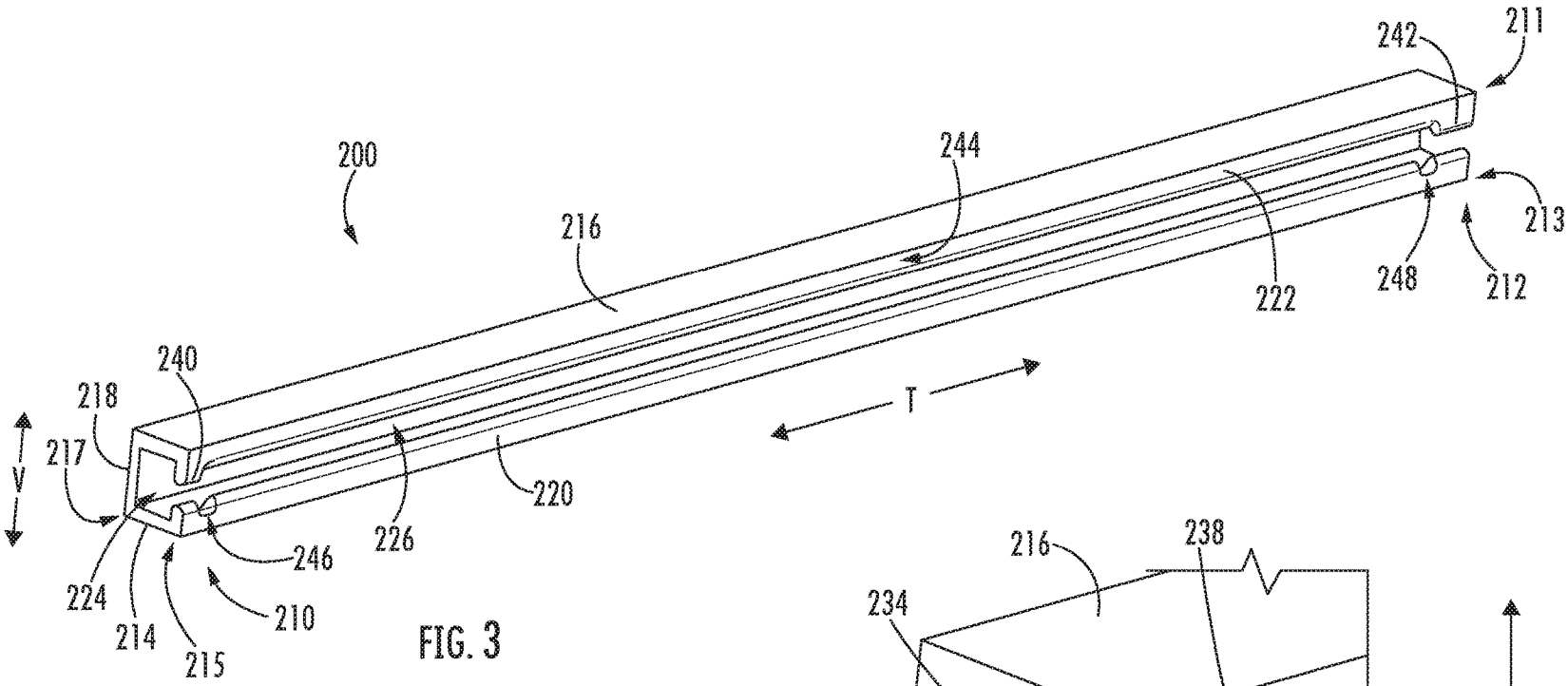
FIG. 3 provides a perspective view of an exemplary shelf mounting structure of a liner of an appliance according to example embodiments of the present disclosure.
Figure 4:
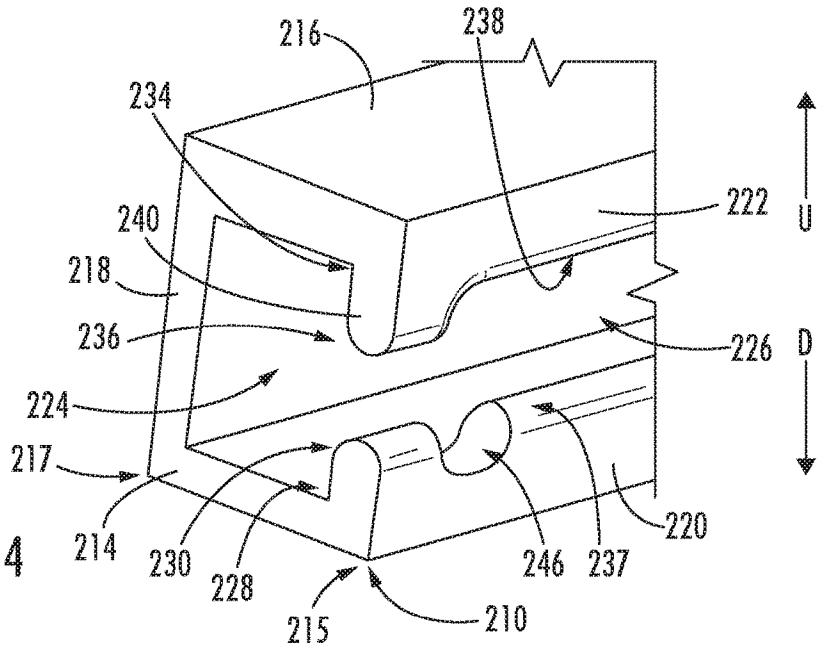
FIG. 4 provides a close up, perspective view of one end of the shelf mounting structure of FIG. 3.

With reference to FIGS. 3 and 4, FIG. 3 provides a perspective view of an exemplary shelf mounting structure 200 that may be integrally formed as part of a liner of an appliance. For instance, shelf mounting structure 200 may be one of the shelf mounting structures 180 of FIG. 2 and the appliance may be the refrigerator appliance 100 of FIGS. 1 and 2. FIG. 4 provides a close up, perspective view of one end of shelf mounting structure 200, and particularly, a close up view of a first end 210 of shelf mounting structure 200 is depicted.

As shown, shelf mounting structure 200 extends between first end 210 and a second end 212, e.g., along the transverse direction T. Shelf mounting structure 200 also extends between a top 211 and a bottom 213, e.g., along the vertical direction V, and between an inner side 215 and an outer side 217, e.g., along the lateral direction L.

Shelf mounting structure 200 includes a bottom wall 214 and a top wall 216 spaced from bottom wall 214, e.g., along the vertical direction V. A connecting wall 218 of shelf mounting structure 200 extends between and connects top wall 216 and bottom wall 214. A bottom projection 220 projects from bottom wall 214. In particular, for this embodiment, bottom projection 220 projects upward U from bottom wall 214 along the vertical direction V. A top projection 222 projects from top wall 216. More particularly, for this embodiment, top projection 222 projects downward D from the top wall 216 along the vertical direction V. Top wall 216, top projection 222, bottom wall 214, and bottom projection 220 generally define a C-shaped cross section when viewed along the transverse direction T. Further, top wall 216, top projection 222, bottom wall 214, and bottom projection 220 define a mounting recess 224 configured to receive a portion of a shelf so that the shelf may be mounted to shelf mounting structure 200. Further, an opening 226 of mounting recess 224 is defined between bottom projection 220 and top projection 222. A shelf may be removably insertable into opening 226 of shelf mounting structure 200. For this embodiment top projection 222 and bottom projection 220 project from their respective walls substantially along the entire length of shelf mounting structure 200.

Figure 15:
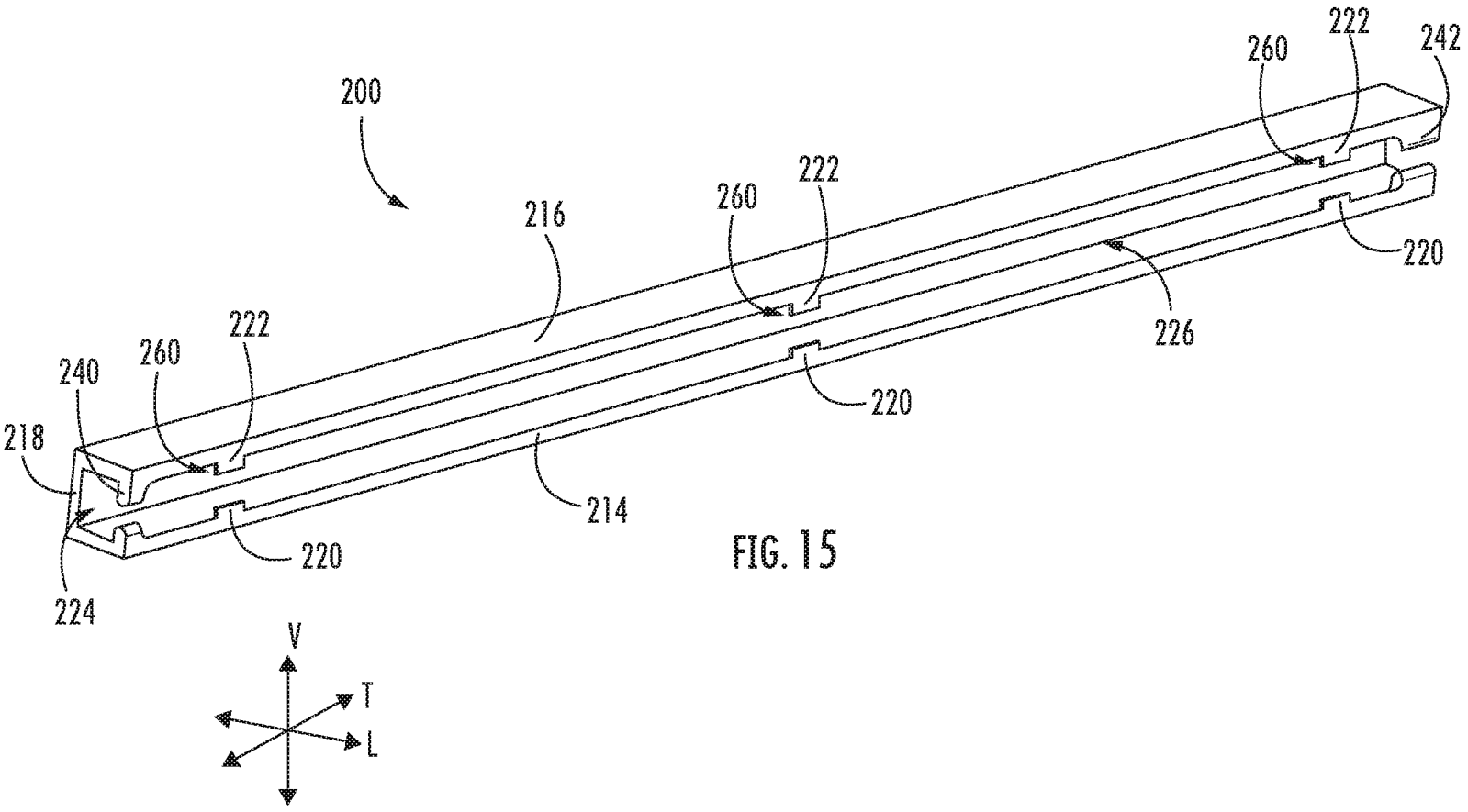
FIG. 15 provides a perspective view of an exemplary shelf mounting structure of a liner of an appliance according to example embodiments of the present disclosure.

In some alternative embodiments, bottom projection 220 and top projection 222 extend along only a portion of the length of shelf mounting structure 200, e.g., the length of shelf mounting structure 200 extending between first end 210 and second end 212 (FIG. 3) along the transverse direction T. Further, as shown in FIG. 15, in some embodiments, top projection 222 projects from top wall 216 and bottom projection 220 projects from bottom wall 214 in an opposed manner along a portion of the length of shelf mounting structure 200 to define a contact section 260. As shown, shelf mounting structure 200 includes a plurality of contact sections 260 that are spaced apart from one another, e.g., along the transverse direction. The contact sections 260 provide structures in which a frame of a shelf may contact, e.g., to further secure the shelf to shelf mounting structure 200. Further, such embodiments may facilitate or ease mounting and removal of shelves from shelf mounting structure 200.

As shown best in FIG. 4, bottom projection 220 extends between a proximal end 228 and a distal end 230, e.g., along the vertical direction V. Proximal end 228 of bottom projection 220 is connected to bottom wall 214 and distal end 230 of bottom projection 220 has a curved surface 232. In particular, for this embodiment, distal end 230 of bottom projection 220 has a semicircle cross section when viewed along the transverse direction T. Similarly, top projection 222 extends between a proximal end 234 and a distal end 236, e.g., along the vertical direction V. Proximal end 234 of top projection 222 is connected to top wall 216 and distal end 236 of top projection 222 has a curved surface 238. In particular, for this embodiment, distal end 236 of top projection 222 has a semicircle cross section when viewed along the transverse direction T.

In addition, as best depicted in FIG. 3, top projection 222 includes a first stop 240, a second stop 242 spaced from first stop 240, and a middle portion 244 extending between first stop 240 and second stop 242, e.g., along the transverse direction T. For this embodiment, first stop 240 is positioned at or proximate first end 210 of shelf mounting structure 200 and second stop 242 is positioned at or proximate second and 212 of shelf mounting structure 200. First stop 240 and second stop 242 each project further from top wall 216 than middle portion 244 of top projection 222, e.g., downward along the vertical direction V. When a shelf is mounted to shelf mounting structure 200 of liner 121 (FIG. 2), first stop 240 and second stop 242 constrain the shelf, e.g., in the transverse direction T. That is, first stop 240 prevents the shelf from moving too far in one direction along the transverse direction T and second stop 242 prevents the shelf from moving too far in the opposite direction. First stop 240 and second stop 242 also facilitate alignment of a shelf being mounted thereto, e.g., by forcing the user to position the shelf between the first and second stops 240, 242.

As further depicted, bottom projection 220 defines a first locking pocket 246 and a second locking pocket 248 spaced from first locking pocket 246, e.g., along the transverse direction T. First locking pocket 246 and second locking pocket 248 are each configured to receive a portion of a frame of a shelf when the shelf is mounted to shelf mounting structure 200, e.g., as shown best in FIG. 8. In some instances, due to the configuration or mounting orientation of the shelf, only one of the locking pockets may receive a portion of the shelf. For this embodiment, first locking pocket 246 is positioned at or proximate first end 210 of shelf mounting structure 200 and second locking pocket 248 is positioned at or proximate second and 212 of shelf mounting structure 200. When a shelf is mounted to shelf mounting structure 200, first locking pocket 246 and second locking pocket 248 secure the shelf in place. First locking pocket 246 and second locking pocket 248 also facilitate alignment of the shelf with the shelf mounting structure 200 during mounting, e.g., by receiving a portion of the frame of the shelf.

Figure 5:
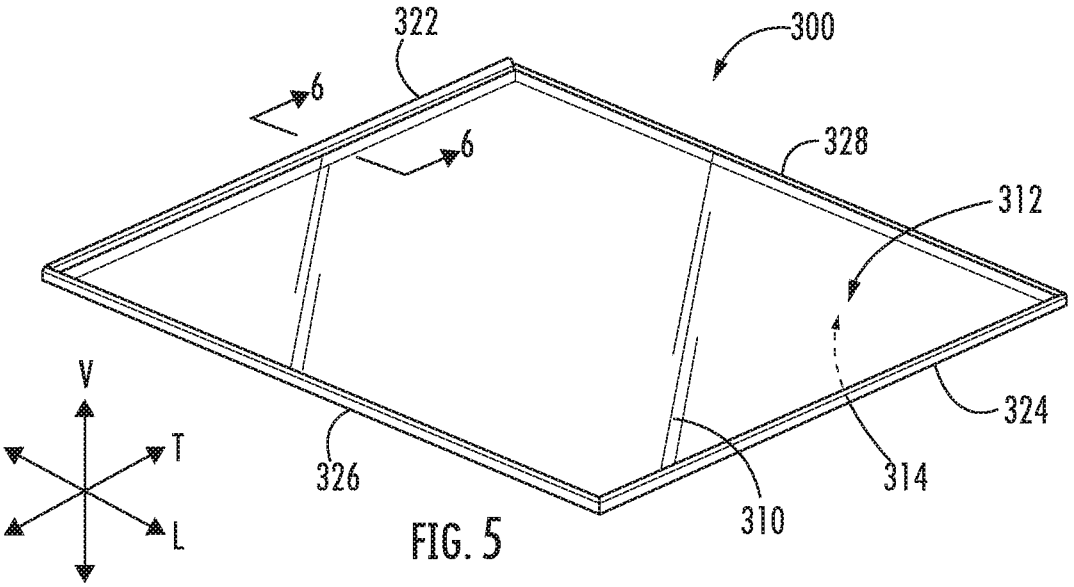
FIG. 5 provides a perspective view of an exemplary shelf according to example embodiments of the present disclosure.
Figure 6:
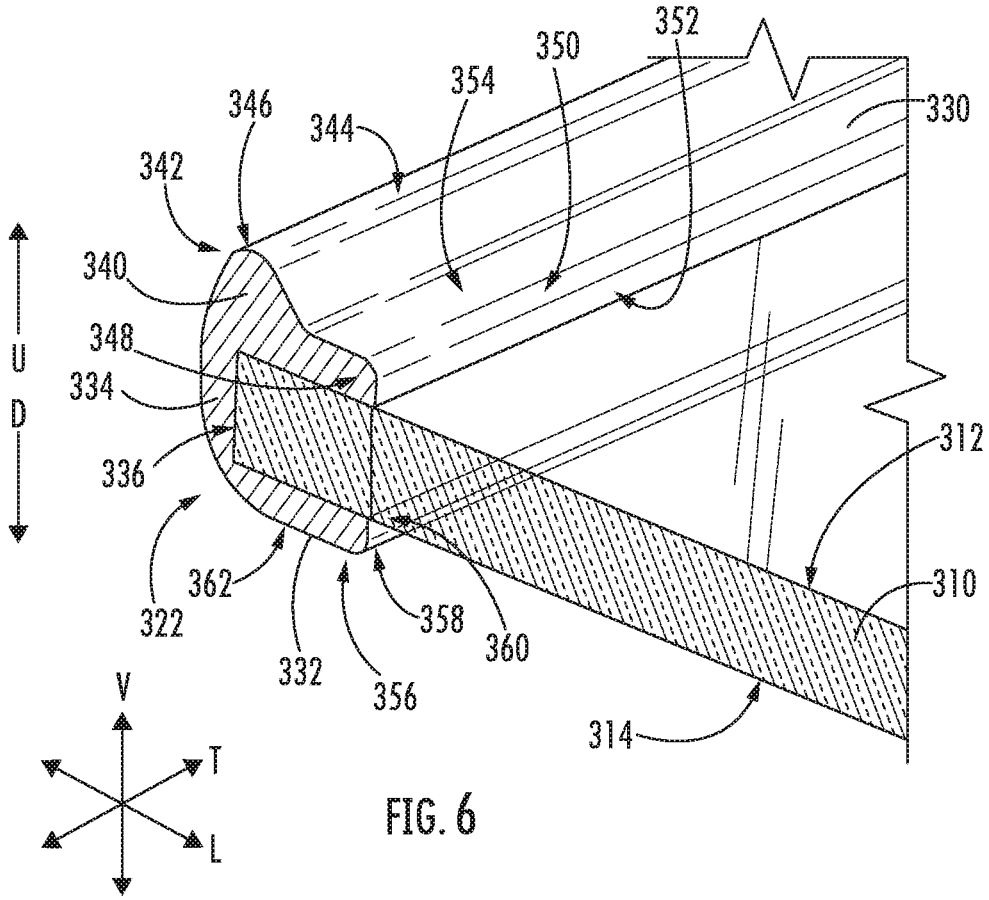
FIG. 6 provides a close up, perspective cross sectional view of the shelf taken along line 6-6 of FIG. 5.

With reference to FIGS. 5 and 6, FIG. 5 provides a perspective view of an exemplary shelf 300 and FIG. 6 provides a close up, perspective cross sectional view of shelf 300 taken along line 6-6 of FIG. 5. For instance, shelf 300 may be one of the shelves 170 of FIG. 2. Shelf 300 may be removably mounted to liner 121, and more particularly, to shelf mounting structure 200 integrally formed in liner 121.

As depicted, shelf 300 includes a panel 310. Panel 310 has a top surface 312 and an opposing bottom surface 314. For this embodiment, shelf panel 310 is formed of a tempered glass. In some embodiments, shelf panel 310 is made of a tempered glass having a thickness of at least five (5) millimeters. However, shelf panel 310 may be made of any suitable material.

Figure 7:
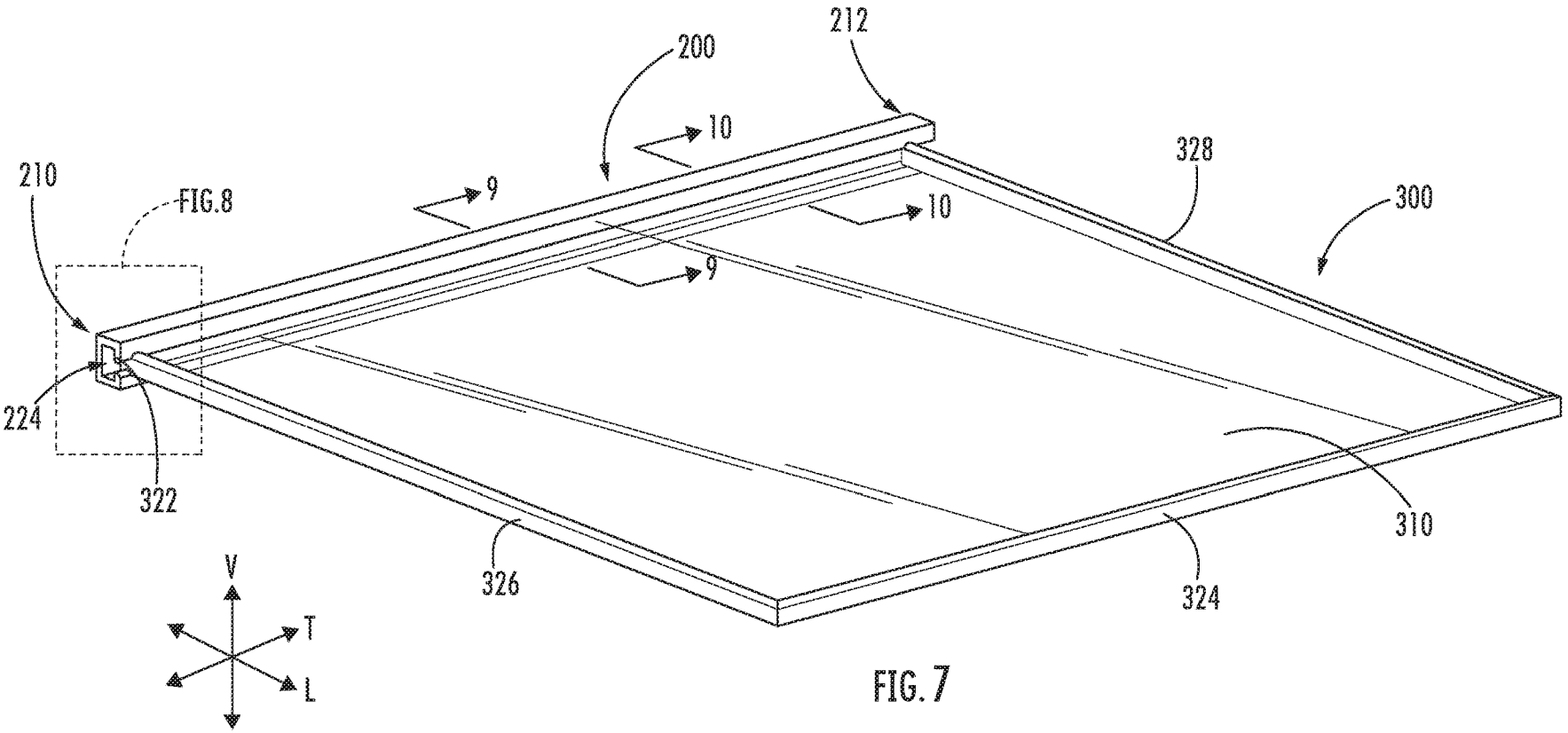
FIG. 7 provides a perspective view of the shelf of FIG. 5 mounted to the shelf mounting structure of FIG. 3.

Shelf 300 also includes a frame 320 connected to panel 310. In particular, for this embodiment, frame 320 surrounds and supports panel 310. Frame 320 includes a receiving member 322 and an opposing member 324. Receiving member 322 is spaced from opposing member 324, e.g., along the lateral direction L. Receiving member 322 is removably insertable into mounting recess 224 of shelf mounting structure 200, e.g., as shown in FIG. 7. Frame 320 also includes a first side member 326 and an opposing second side member 328. First side member 326 is spaced from second side member 328, e.g., along the transverse direction T. First side member 326 and second side member 328 each extend between and connect receiving member 322 with opposing member 324. Accordingly, frame 320 extends about the perimeter of panel 310. Receiving, opposing, and first and second side members 322, 324, 326, 328 can be made of any suitable materials, such as metal or plastic. In some alternative embodiments, the frame 320 need not extend about the perimeter of panel 310. For instance, in some embodiments, the frame 320 may only include receiving member 322 and the remaining sides of the panel 310 may be left open, e.g., with glass or another suitable material of the panel 310 exposed. In other embodiments, the frame 320 may include receiving member 322 and opposing member 324 with the sides left open or exposed. Other configurations are also possible.

As shown best in FIG. 6, receiving member 322 includes a top retaining member 330, a bottom retaining member 332 spaced from top retaining member 330, e.g., along the vertical direction V. A connecting retaining member 334 extends between and connects top retaining member 330 and bottom retaining member 324. Top retaining member 330, bottom retaining member 332, and connecting retaining member 334 define a panel recess 336 configured to receive panel 310 of shelf 300.

Further, receiving member 322 of frame 320 includes a top contacting projection 340 that projects from top retaining member 330. In particular, for this embodiment, top contacting projection 340 projects upward U from top retaining member 330, e.g., along the vertical direction V. More particularly still, top contacting projection 340 projects from top retaining member 330 upward U along the vertical direction V and toward opposing member 324 (as shown best in FIGS. 9 and 11), e.g., along the lateral direction L. As shown in FIG. 11, top retaining member 330 is connected to top contacting projection 340 at its base and an inner radius RI is defined at an inner side of top contacting projection 340 and an outer radius RO is defined at an outer side of top contacting projection 340. As depicted, the outer radius RO is greater than the inner radius RI. Returning to FIG. 6, top contacting projection 340 has a cross section shaped generally as a triangle with rounded corners. In particular, top contacting projection 340 has a contacting end 342 that has a curved surface 344. Contacting end 342 of top contacting projection 340 defines an apex 346 at its most distal end. As will be described in greater detail herein, when shelf 300 is mounted to liner 121 (FIG. 2), e.g., to shelf mounting structure 200 of liner 121, top contacting projection 340 of frame 320 engages top wall 216 of shelf mounting structure 200, e.g., as shown in FIGS. 9, 10, and 11.

In some exemplary embodiments, one or both of first side member 326 and second side member 328 include the mounting features of receiving member 322. Stated more particularly, in some embodiments, first side member 326 or second side member 328 (or both) include a top contacting projection that projects from top retaining member in the same manner as described above with respect to receiving member 322. In this way, shelf 300 may be rotated, e.g., by ninety degrees (90°), and the side member that includes the mounting features may be received within mounting recess 224 so that shelf 300 may be mounted to liner 121 (FIG. 2), or more particularly to shelf mounting structure 200 of liner 121. Accordingly, the mounting orientation of shelf 300 is thus advantageously flexible, providing convenience to a user.

In addition, for this exemplary embodiment, top retaining member 330 includes a curved surface 350 at its inner end 348. As shown, curved surface 350 at inner end 348 of top retaining member 330 transitions an inner vertical surface 352 of top retaining member 330 and a top surface 354 of top retaining member 330. Similarly, bottom retaining member 332 includes a curved surface 358 at its inner end 356. As shown, curved surface 358 at inner end 356 of bottom retaining member 332 transitions an inner vertical surface 360 of top retaining member 330 and a bottom surface 362 of bottom retaining member 332.

Figure 8:
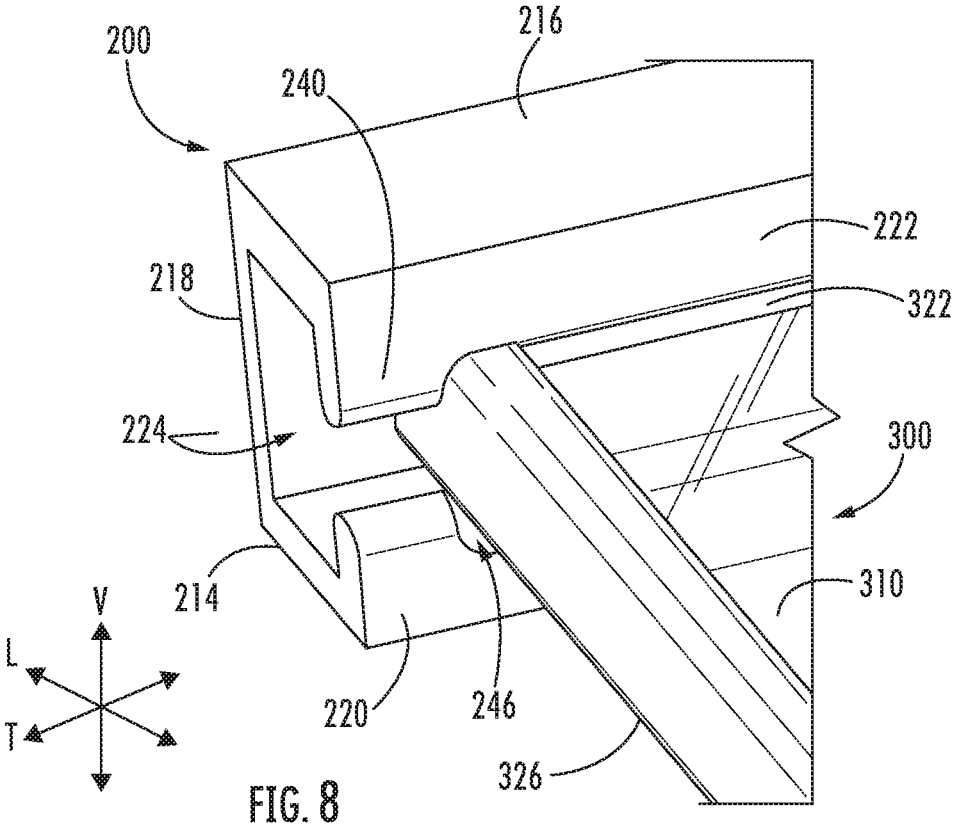
FIG. 8 provides a close up, perspective view of Section 8 of FIG. 7.
Figure 9:
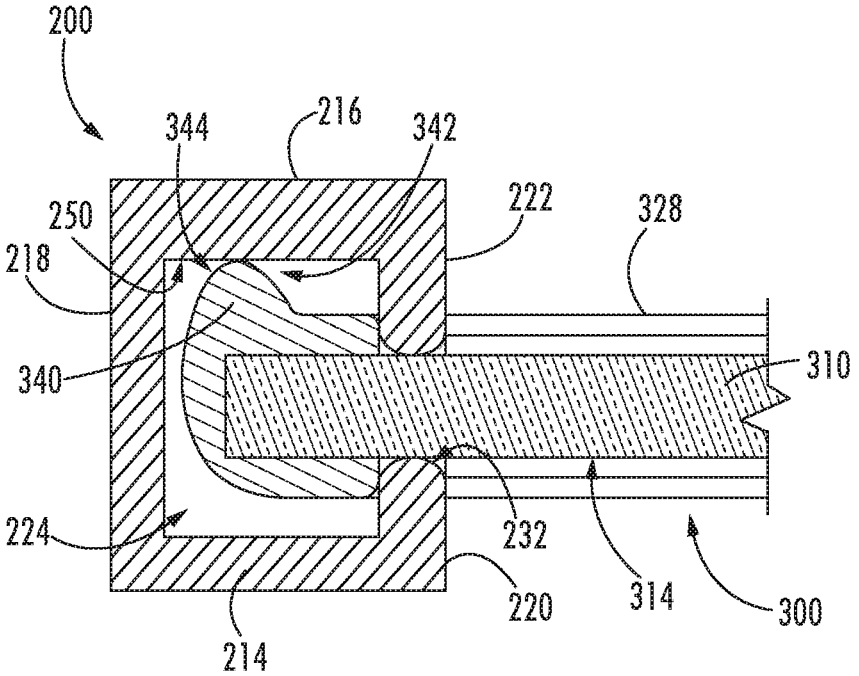
FIG. 9 provides a close up, cross-sectional view of the shelf mounted to the shelf mounting structure taken along line 9-9 of FIG. 7.
Figure 10:
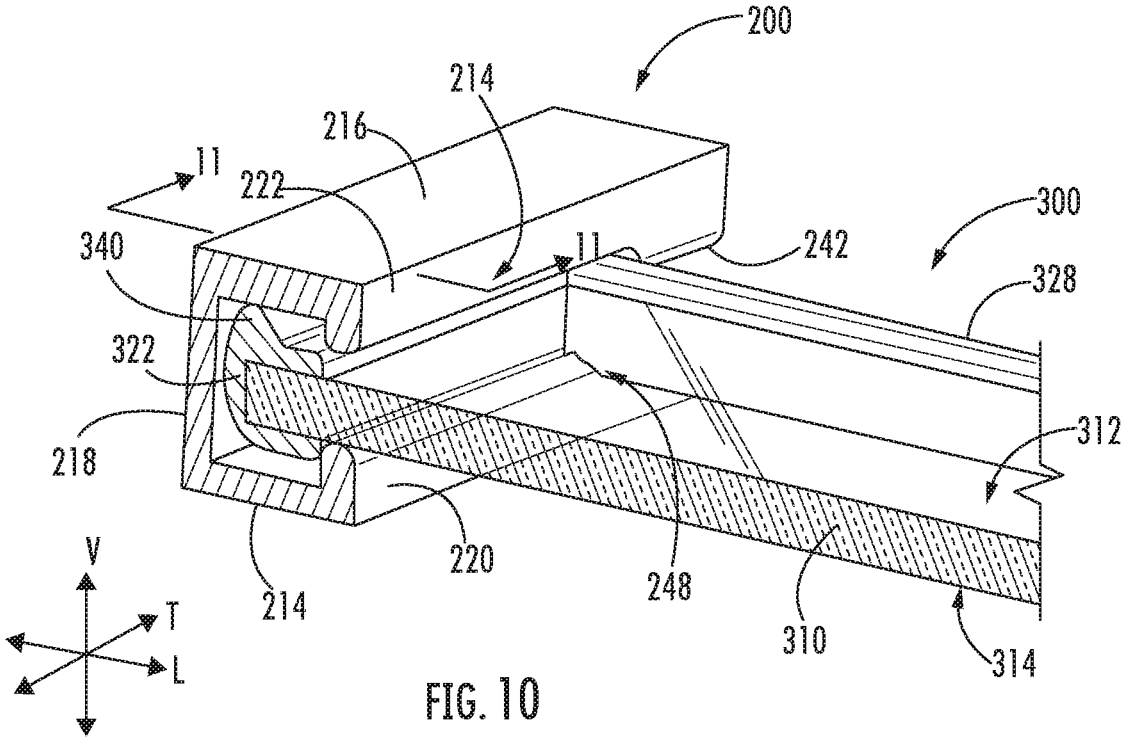
FIG. 10 provides a close up, perspective cross-sectional view of the shelf mounted to the shelf mounting structure taken along line 10-10 of FIG. 7.
Figure 11:
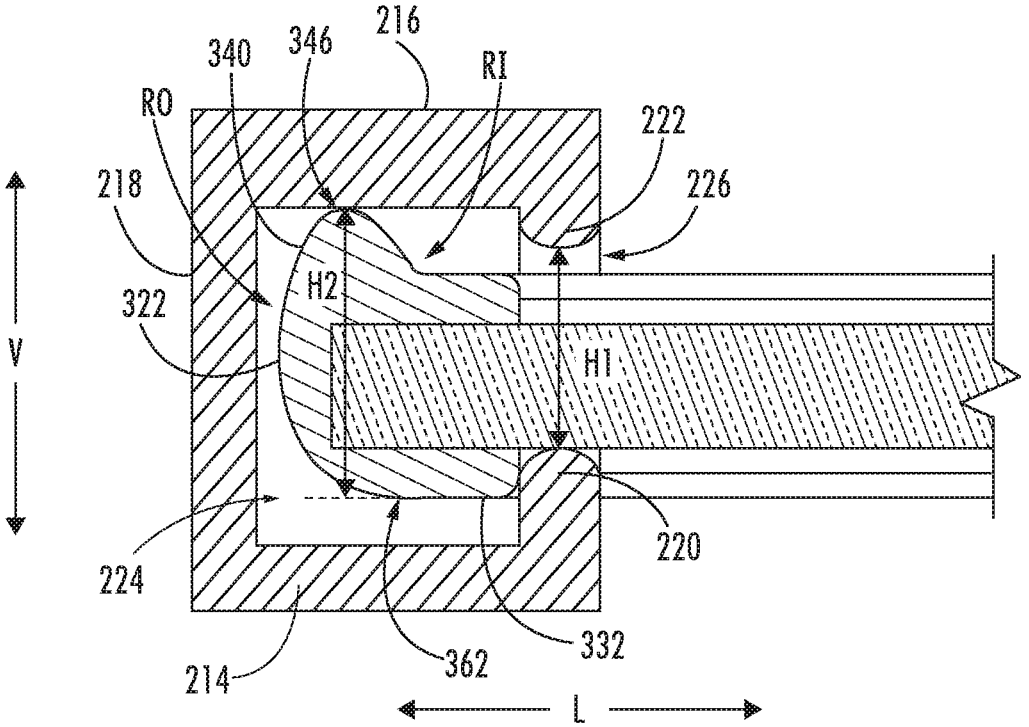
FIG. 11 provides a close up, cross-sectional view of the shelf mounted to the shelf mounting structure taken along line 11-11 of FIG. 10.

FIGS. 7, 8, 9, 10, and 11 depict various views of shelf 300 mounted to shelf mounting structure 200. In particular, FIG. 7 provides a perspective view of shelf 300 mounted to shelf mounting structure 200. FIG. 8 provides a close up, perspective view of Section 8 of FIG. 7. FIG. 9 provides a close up, cross-sectional view of shelf 300 mounted to shelf mounting structure 200 taken along line 9-9 of FIG. 7. FIG. 10 provides a close up, perspective cross-sectional view of shelf 300 mounted to shelf mounting structure 200 taken along line 10-10 of FIG. 7. FIG. 11 provides a close up, cross-sectional view of shelf 300 mounted to shelf mounting structure 200 taken along line 11-11 of FIG. 10.

As shown in FIG. 7, when shelf 300 is mounted to shelf mounting structure 200, receiving member 322 is received within mounting recess 224 defined by shelf mounting structure 200. For this embodiment, shelf 300 extends approximately between first end 210 and second end 212 of shelf mounting structure 200 and is cantilevered from shelf mounting structure 200. Further, as depicted in FIG. 8, when shelf 300 is mounted to shelf mounting structure 200, first stop 240 constrains receiving member 322, e.g., in the transverse direction T, and first side member 326 of frame 320 is received within first locking pocket 246 defined by bottom projection 220. Similarly, as shown in FIG. 10, when shelf 300 is mounted to shelf mounting structure 200, second stop 242 constrains receiving member 322, e.g., in the transverse direction T, and second side member 328 of frame 320 is received within second locking pocket 248 defined by bottom projection 220.

As illustrated in FIG. 9, when shelf 300 is mounted to liner 121 (FIG. 2), e.g., to shelf mounting structure 200 of liner 121, top contacting projection 340 of frame 320 engages top wall 216 of shelf mounting structure 200. More particularly, the curved surface 344 of the contacting end 342 of top contacting projection 340 engages a bottom surface 250 of top wall 216 of shelf mounting structure 200. The engagement of top contacting projection 340 with top wall 216 defines a top loading contact point, or a point in which the load placed on the shelf 300 and the shelf 300 itself is distributed to shelf mounting structure 200 of liner 121. It will be appreciated that the top loading contact point extends along the transverse length of the assembly as top contacting projection 340 engages top wall 216 substantially this transverse length. Further, when shelf 300 is mounted to liner 121 (FIG. 2), e.g., to shelf mounting structure 200 of liner 121, panel 310 of shelf 300 engages bottom projection 220 of shelf mounting structure 200. More particularly, bottom surface 314 of panel 310 engages curved surface 232 of bottom projection 220. The engagement of panel 310 with bottom projection 220 defines a bottom loading contact point. It will be appreciated that the bottom loading contact point extends along the transverse length of the assembly. Accordingly, the total shelf load (i.e., the weight of shelf 300 and any items placed thereon) is distributed to shelf mounting structure 200 at the top loading contact point and the bottom loading contact point.

As further shown in FIG. 9, when shelf 300 is mounted to shelf mounting structure 200 of liner 121 (FIG. 2), bottom retaining member 332 engages bottom projection 220 and top retaining member 330 engages top projection 222 along at least a portion of the transverse length of the assembly. When bottom retaining member 332 engages bottom projection 220, shelf 300 is constrained, e.g. in the lateral direction L, and thus receiving member 322 of shelf 300 is prevented from being pulled out of mounting recess 224, e.g., by the shelf load. Similarly, when top retaining member 330 engages top projection 222, shelf 300 is further constrained, e.g. in the lateral direction L.

In addition, as shown in FIG. 11, a height H1 of the opening 226 of mounting recess 224 is defined between top projection 222 and bottom projection 220 of shelf mounting structure 200 of liner 121 (FIG. 2). Further, a height H2 of receiving member 322 of frame 320 is defined between apex 346 of top contacting projection 340 and bottom surface 362 of bottom retaining member 332. As shown, the height H2 of receiving member 322 is greater than the height H1 of the opening 226 of the mounting recess 224. Thus, even if shelf 300 begins to angle downward, e.g., due to an excessive load on shelf 300, receiving member 322 will remain lodged within mounting recess 224. That is top contacting projection 340 will continue to catch on some portion of shelf mounting structure 200 no matter the downward angle of shelf 300. This may for example, prevent shelf 300 from falling downward and being damaged when an excessive load is applied to shelf 300, e.g., a load over fifty (50) pounds.

Figure 12:
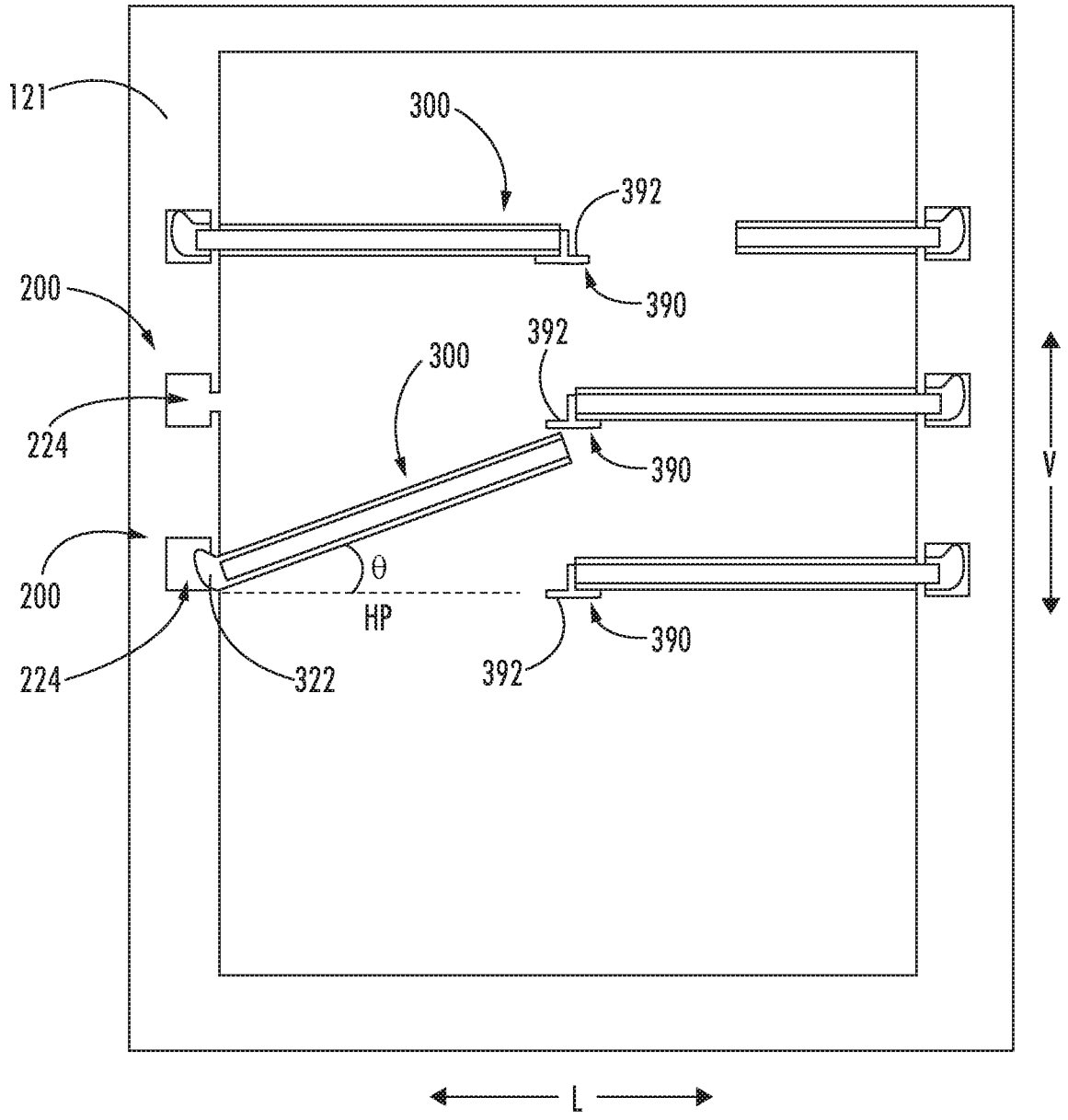
FIG. 12 provides a schematic view of an exemplary shelf being mounted to liner according to example embodiments of the present disclosure.

Notably, while the varying heights and top contacting projection 340 described above prevent shelf 300 from being dislodged from shelf mounting structure at a downward angle, shelf 300 may be inserted into or removed from mounting recess 224 by tilting or angling shelf 300 upward relative to a horizontal reference plane, i.e., a plane orthogonal to the vertical direction V. As shown in FIG. 12, one exemplary shelf 300 is shown being angled upward so that it may be inserted into mounting recess 224 of one of the shelf mounting structures 200. For this embodiment, by rotating shelf 300 upward by an angle θ, e.g., forty-five degrees (45°) with respect to the horizontal reference plane HP, receiving member 322 of shelf 300 may be inserted into mounting recess 224 so that shelf 300 may be mounted to shelf mounting structure 200 of liner 121 (FIG. 2). Notably, the curved surfaces 350, 358 of top retaining member 350 and bottom retaining member 332 (FIG. 6), respectively, and the curved surfaces 232, 238 of bottom projection 220 and top projection 222 (FIG. 4), respectively, facilitate and allow for receiving member 322 of shelf 300 to ease into mounting recess 224 when shelf 300 is mounted to shelf mounting structure 200. As further provided in FIG. 12, in some embodiments, one or more shelves 300 include a secondary support member 390. The secondary support member 390 may be formed as a part of the frame or may be a separate component. For instance, the secondary support member 390 may be integrally formed with or attached to the opposing member 324 (FIG. 7). As shown, the secondary support member 390 includes a projection 392 that projects outward from the shelf 300, e.g., along a direction that is orthogonal to the vertical direction V. The secondary support member 390 may facilitate shelf to shelf alignment, e.g., when two shelves are mounted within the same vertical plane, and may allow for a load placed on one shelf to be distributed to the other shelf. The secondary support member 390 may also catch or retain a shelf as it is rotated downward into position. In this way, the shelf may be prevented from being over rotated and may facilitate its alignment along the vertical direction V.

Figure 13:
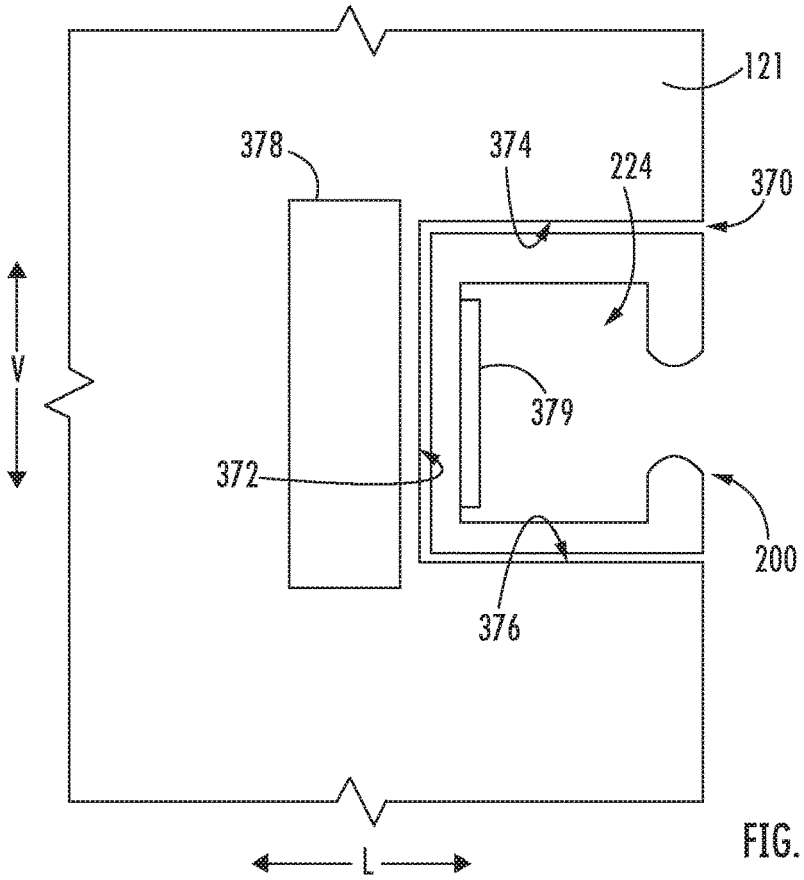
FIG. 13 provides a close up, cross-sectional view of an exemplary liner defining a groove and having a shelf mounting structure disposed therein according to example embodiments of the present disclosure.

FIG. 13 provides a close up, cross-sectional view of exemplary liner 121 defining a groove 370 and having shelf mounting structure 200 disposed therein according to example embodiments of the present disclosure. As shown, for this embodiment, shelf mounting structure 200 is not integrally formed or made as a single monolithic piece with liner 121. Rather, for this embodiment, shelf mounting structure 200 includes all of the same mounting features as described above except that shelf mounting structure 200 is a separate component and is placed or fit within groove 370 defined by liner 121. For example, shelf mounting structure 200 may be placed into groove 370 with an interference fit. Advantageously, as groove 370 is defined by an inner wall 372, an upper wall 374, and a lower wall 376 spaced from upper wall 374, e.g., along the vertical direction V, the manufacturing complexity of liner 121 may be simplified, e.g., compared to integrally forming shelf mounting structure 200 with liner 121. In some alternative embodiments, shelf mounting structure 200 may be formed integrally with a wall member that is attached to the liner 121. For instance, the wall member may be sized complementary to sidewall 123 or rear wall 125 of liner 121 (FIG. 2). The wall member may include a plurality of shelf mounting structures 200. In some embodiments, the shelf mounting structures 200 are adjustable, e.g., along the vertical direction V.

As further shown in FIG. 13, in some exemplary embodiments, liner 121 includes a vertical insulation panel 378. Vertical insulation panel 378 extends along inner wall 372, e.g., along the vertical direction V. Vertical insulation panel 378 has a higher R-value than the installation surrounding liner 121 and is configured to provide improved thermal and moisture control proximate groove 370. Although vertical insulation panel 378 is shown in the embodiment of FIG. 13, it will be appreciated that vertical insulation panel 378 may be incorporated into other embodiments described herein.

As further shown in FIG. 13, a lighting device 379 is disposed within mounting recess 224 of shelf mounting structure 200. Lighting device 379 is configured for illuminating a chilled chamber of refrigerator appliance 100, e.g., to create an accent light. In some embodiments, lighting device 379 is configured to switch the color of the light illuminated therefrom in accordance with a user's preference. For instance, lighting device 379 may configured to illuminate a blue, red, green, or yellow light. In some embodiments, multiple colors may be illuminated at once. The illuminated light may diffuse or scatter outward into the chilled chamber to provide a pleasing aesthetic to a user.

Lighting device 379 may extend the entire length of shelf mounting structure 200 in which it is disposed or may extend along a portion of the length of the shelf mounting structure 200. In some embodiments, lighting device 379 includes a plurality of light emitting elements spaced from one another, e.g., along the transverse length of shelf mounting structure 200. Lighting device 379 may receive electrical power from any suitable source, such as a line voltage. Although lighting device 379 is shown in the embodiment of FIG. 13, it will be appreciated that lighting device 379 may be incorporated into other embodiments described herein.

Figure 14:
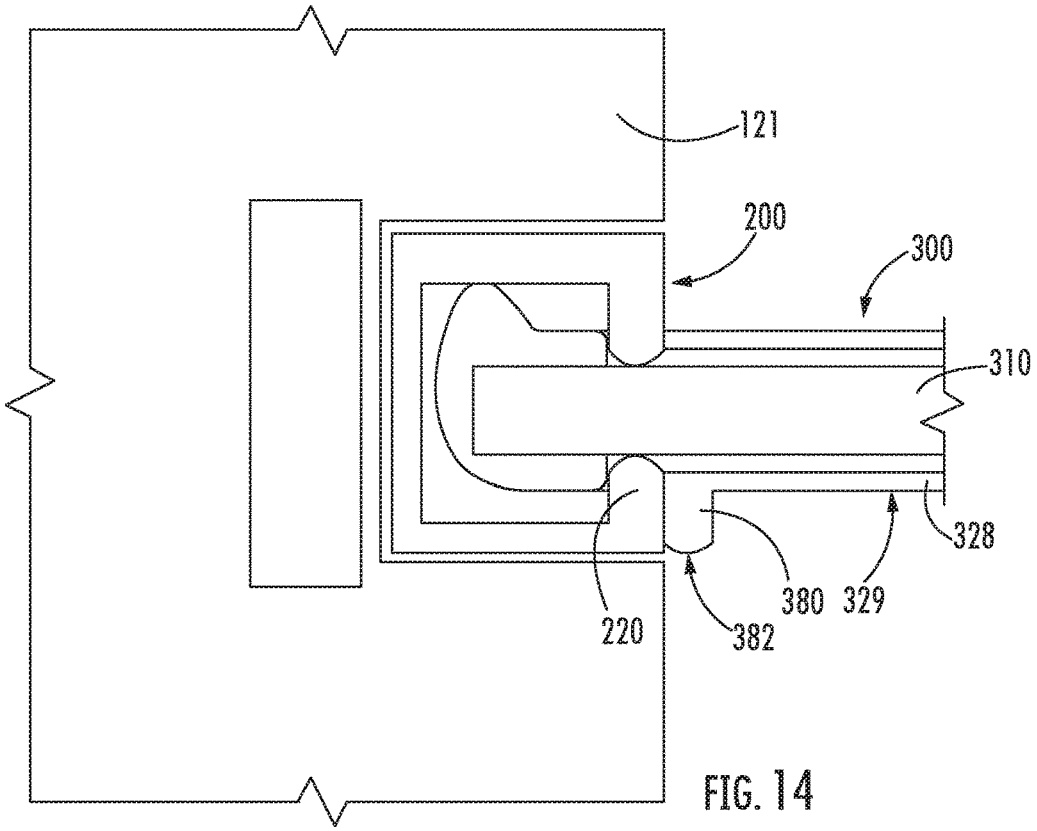
FIG. 14 provides a close up, cross-sectional view of the liner of FIG. 13 depicting an exemplary shelf mounted to the shelf mounting structure.

FIG. 14 provides a close up, cross-sectional view of liner 121 of FIG. 13 depicting shelf 300 mounted to shelf mounting structure 200. As shown, for this embodiment, second side member 328 includes a protrusion 380 projecting therefrom. More particularly, protrusion 380 projects from a bottom surface 329 of second side member 328. Protrusion 380 has a curved surface 382 at its distal end. When shelf 300 is mounted to liner 121, or in this embodiment shelf mounting structure 200 disposed within groove 370 defined by liner 121, protrusion 380 engages bottom projection 220. Protrusion 380 further secures shelf 300 to liner 121. That is, the engagement of protrusion 380 of second side member 328 with bottom projection 220 of shelf mounting structure 200 defines a third loading contact point in which the load of shelf 300 is distributed to shelf mounting structure 200 and ultimately liner 121. Thus, in such embodiments, the load of shelf 300 is distributed to shelf mounting structure 200 through three (3) loading contact points, including the top loading contact point (where top contacting projection 340 engages top wall 216), the bottom loading contact point (where panel 310 engages bottom projection 220), and the third loading contact point (where protrusion 380 engages bottom projection 220). As will be appreciated, in some embodiments first side member 326 may likewise include a protrusion that projects from its bottom surface in a manner as described above for second side member 328. In some embodiments, only first side member 326 includes a protrusion. In some embodiments, both first side member 326 and second side member 328 include protrusions. Further, although protrusion 380 is shown in the embodiment of FIG. 14, it will be appreciated that protrusions 380 extending from one or both of first side 326 and second side member 328 may be incorporated into other embodiments described herein, e.g., in embodiments in which shelf mounting structure 200 is integrally formed with liner 121.

In some exemplary embodiments, the features of the shelf mounting structures described herein may be incorporated into a track configured to be mounted to a liner. For instance, the track may have the same or similar features as the shelf mounting structure shown in FIGS. 3 and 4.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet;

a liner positioned within the cabinet and defining a chilled chamber, the liner comprising a shelf mounting structure integrally formed with the liner, the shelf mounting structure comprising:

a bottom wall;

a bottom projection projecting from the bottom wall;

a top wall spaced from the bottom wall;

a top projection projecting from the top wall, wherein the top wall, the top projection, the bottom wall, and the bottom projection define a mounting recess, and wherein an opening of the mounting recess is defined between the bottom projection and the top projection; and a shelf removably mounted to the liner, the shelf comprising:

a panel; and a frame connected to the panel and having a receiving member that is removably insertable into the mounting recess, the receiving member of the frame comprising a top contacting projection;

wherein when the shelf is mounted to the shelf mounting structure, the top contacting projection of the frame of the shelf engages the top wall of the shelf mounting structure and the panel of the shelf engages the bottom projection of the shelf mounting structure.

2. The refrigerator appliance of claim 1, wherein the bottom projection defines a first locking pocket and a second locking pocket spaced from the first locking pocket, the first locking pocket and the second locking pocket each configured to receive a portion of the frame of the shelf when the shelf is mounted to the liner.

3. The refrigerator appliance of claim 1, wherein the bottom projection extends between a proximal end and a distal end, the proximal end of the bottom projection connected to the bottom wall, and wherein the distal end of the bottom projection has a curved surface.

4. The refrigerator appliance of claim 1, wherein the refrigerator appliance defines a vertical direction, and wherein the top projection comprises a first stop, a second stop spaced from the first stop, and a middle portion extending between the first stop and the second stop, and wherein the first stop and the second stop project further from the top wall than the middle portion along the vertical direction.

5. The refrigerator appliance of claim 1, wherein the receiving member of the frame comprises a top retaining member, a bottom retaining member spaced from the top retaining member, a connecting retaining member extending between and connecting the top retaining member with the bottom retaining member, wherein the top retaining member, the bottom retaining member, and the connecting retaining member define a panel recess configured to receive the panel of the shelf.

6. The refrigerator appliance of claim 5, wherein when the shelf is mounted to the liner, the bottom retaining member engages the bottom projection of the liner.

7. The refrigerator appliance of claim 5, wherein when the shelf is mounted to the liner, the top retaining member engages the top projection of the liner.

8. The refrigerator appliance of claim 5, wherein a height of the opening of the mounting recess is defined between the top projection and the bottom projection of the liner, and wherein a height of the receiving member of the frame is defined between an apex of the top contacting projection and a bottom surface of the bottom retaining member, and wherein the height of the receiving member of the frame is greater than the height of the opening of the mounting recess.

9. The refrigerator appliance of claim 1, wherein the top contacting projection has a curved surface.

10. The refrigerator appliance of claim 1, wherein the frame of the shelf comprises a first side member connected to the receiving member, the first side member having a bottom surface and a protrusion projecting from the bottom surface, and wherein when the shelf is mounted to the liner, the protrusion engages the bottom projection.

11. The refrigerator appliance of claim 1, further comprising:

a lighting device disposed within the mounting recess for illuminating the chilled chamber through the panel when the shelf is mounted to the shelf mounting structure.

12. The refrigerator appliance of claim 1, wherein the shelf mounting structure is integrally formed with the liner as a single, monolithic piece.

13. A refrigerator appliance, comprising:

a cabinet;

a liner positioned within the cabinet and defining a chilled chamber and a groove;

a shelf mounting structure disposed within the groove and connected to the liner, the shelf mounting structure comprising:

a bottom wall;

a bottom projection projecting from the bottom wall;

a top wall spaced from the bottom wall;

a top projection projecting from the top wall, wherein the top wall, the top projection, the bottom wall, and the bottom projection define a mounting recess; and a shelf removably mounted to the liner, the shelf comprising:

a panel; and a frame connected to the panel and having a receiving member that is removably insertable into the mounting recess, the receiving member of the frame comprising a top contacting projection, the top contacting projection comprising a contacting end having a curved surface;

wherein when the shelf is mounted to the shelf mounting structure, the curved surface of the contacting end of the top contacting projection engages the top wall of the shelf mounting structure and the panel of the shelf engages the bottom projection of the shelf mounting structure.

14. The refrigerator appliance of claim 13, wherein the shelf mounting structure defines a length, wherein the top projection and the bottom projection extend substantially along the length of the shelf mounting structure.

15. The refrigerator appliance of claim 13, wherein the groove is defined by an inner wall, an upper wall, and a lower wall of the liner, and wherein a vertical insulation panel extends along the inner wall.

16. The refrigerator appliance of claim 13, wherein the bottom projection extends between a proximal end and a distal end, the proximal end of the bottom projection connected to the bottom wall, and wherein the distal end of the bottom projection has a curved surface, and wherein the top projection extends between a proximal end and a distal end, the proximal end of the top projection connected to the top wall, and wherein the distal end of the top projection has a curved surface.

17. The refrigerator appliance of claim 13, wherein the frame connected to the panel comprises an opposing member opposing the receiving member and a first side member and a second side member spaced from the first side member extending between and connecting the receiving member with the opposing member, and wherein at least one of the first side member and the second side member comprise a top contacting projection, the top contacting projection comprising a contacting end having a curved surface.

18. The refrigerator appliance of claim 13, wherein the refrigerator appliance defines a vertical direction, and wherein the frame connected to the panel comprises an opposing member opposing the receiving member, and wherein the shelf comprises a secondary support member integrally formed with or attached to the opposing member, the secondary support member having a projection extending in a direction orthogonal to the vertical direction.

19. A refrigerator appliance, comprising:

a cabinet;

a liner positioned within the cabinet and defining a chilled chamber and a groove;

a shelf mounting structure disposed within the groove, the shelf mounting structure comprising:

a bottom wall;

a bottom projection projecting from the bottom wall;

a top wall spaced from the bottom wall;

a top projection projecting from the top wall, wherein the top wall, the top projection, the bottom wall, and the bottom projection define a mounting recess; and a shelf removably mounted to the liner, the shelf comprising:

a panel; and a frame connected to the panel and having a receiving member that is removably insertable into the mounting recess, the receiving member of the frame comprising a top contacting projection, the top contacting projection comprising a contacting end having a curved surface.

20. The refrigerator appliance of claim 19, wherein the frame connected to the panel comprises an opposing member opposing the receiving member and a first side member and a second side member spaced from the first side member extending between and connecting the receiving member with the opposing member, and wherein at least one of the first side member and the second side member comprise a top contacting projection, the top contacting projection comprising a contacting end having a curved surface.

* * * * *